US006352744B1

(12) United States Patent
Trumbore et al.

(10) Patent No.: US 6,352,744 B1
(45) Date of Patent: Mar. 5, 2002

(54) VACUUM TREATMENT OF ASPHALT COATING

(75) Inventors: David Charles Trumbore, La Grange, IL (US); David B. Ollett, Pickerington; Frank Joseph Macdonald, Granville, both of OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/583,843

(22) Filed: May 31, 2000

(51) Int. Cl.[7] ..... B05D 3/12

(52) U.S. Cl. ..... 427/187; 427/186; 427/294; 427/296; 427/289; 427/420

(58) Field of Search ..... 427/294, 296, 427/298, 420, 289, 186, 187

(56) References Cited

U.S. PATENT DOCUMENTS

| | | | | |
|---|---|---|---|---|
| 2,186,957 A | | 1/1940 | Collings et al. | |
| 3,669,064 A | | 6/1972 | Hoelzinger et al. | |
| 3,766,000 A | | 10/1973 | Gibson et al. | |
| 3,779,860 A | | 12/1973 | Oshida et al. | |
| 3,904,791 A | | 9/1975 | Iverson et al. | |
| 4,035,544 A | * | 7/1977 | Iwasaki et al. | 427/442 |
| 4,077,928 A | | 3/1978 | Koons | |
| 4,452,832 A | | 6/1984 | Wrenn, Jr. et al. | |
| 4,869,198 A | | 9/1989 | Quillen | |
| 4,961,955 A | * | 10/1990 | Goldberg | 427/294 |
| 5,395,644 A | * | 3/1995 | Affinito | 427/294 |
| 5,447,753 A | * | 9/1995 | Noda et al. | 427/296 |
| 5,516,573 A | * | 5/1996 | George et al. | 428/143 |
| 5,940,952 A | | 8/1999 | Ikeda et al. | |
| 6,186,700 B1 | * | 2/2001 | Omann | 404/79 |

FOREIGN PATENT DOCUMENTS

JP 4-305439 8/1992

OTHER PUBLICATIONS

Illinois Roofing Corporation, Glossary of Roofing Terms, last updated Nov. 16, 1998; web page.

* cited by examiner

*Primary Examiner*—Shrive P. Beck
*Assistant Examiner*—Kirsten A. Crockford
(74) *Attorney, Agent, or Firm*—James J. Dottavio; Inger H. Eckert

(57) ABSTRACT

In a method of reducing voids in an asphalt roofing product, an asphalt coating material having voids is contacted with a vacuum in an amount effective to reduce the voids in the coating material. A mat is coated with the coating material to make an asphalt roofing product. The vacuum contacting step occurs prior to the coating step. The vacuum contacting step causes the roofing product to have reduced voids visible on a top surface compared to the same roofing product made with a coating material not contacted with vacuum.

19 Claims, 5 Drawing Sheets

VACUUM TREATMENT OF ASPHALT COATING

TECHNICAL FIELD AND INDUSTRIAL APPLICABILITY OF THE INVENTION

This invention relates in general to a method of producing an asphalt roofing product. More particularly, the invention relates to a method of producing an asphalt roofing product having reduced voids in the asphalt coating.

BACKGROUND OF THE INVENTION

Asphalt roofing products, such as roofing shingles, roll roofing and commercial roofing, are installed on the roofs of buildings to provide protection from the elements. Typically, the roofing product is constructed of a mat such as a glass fiber mat or an organic felt, an asphalt coating material on the mat, and a surface layer of granules embedded in the asphalt coating material. During manufacture, an asphalt roofing product can experience voids in the asphalt coating. A void may comprise an enclosed pocket of air within the asphalt coating of the roofing product.

The prior art fails to address this problem. For example, U.S. Pat. No. 2,186,957 to Collings et al. discloses a method for uniformly coating a fibrous sheet with a film-forming material. Reduced pressure or vacuum is applied simultaneously with or immediately after the application of the coating film to the fibrous sheet. Such procedure results in removing air bubbles from between the newly deposited film and the fibrous sheet. U.S. Pat. No. 4,869,198 to Quillen discloses a vacuum debubbler machine used for removing entrained or surface bubbles from a liquid coating on a substrate such as a printed circuit board. The substrate is first coated and then transported to the machine for bubble removal. These patents do not suggest a method in which a coating is contacted with a vacuum prior to applying the coating. The patents are unrelated to asphalt roofing products and to the problem of asphalt coating voids. Therefore, it would be desirable to provide a method of reducing voids in an asphalt roofing product.

SUMMARY OF THE INVENTION

The above object as well as others not specifically enumerated are achieved by a method of reducing voids in an asphalt roofing product according to the invention. In the method, an asphalt coating material having air voids is contacted with a vacuum in an amount effective to reduce the voids in the coating material. A mat is coated with the coating material to make an asphalt roofing product. The vacuum contacting step occurs prior to the coating step. The vacuum contacting step causes the roofing product to have reduced voids compared to the same roofing product made with a coating material not contacted with vacuum.

In a specific embodiment of the invention, the method is applied to an asphalt roofing product made with a coating material containing from about 40% to about 80% filler.

In another specific embodiment, the method is applied in the production of asphalt roofing shingles.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
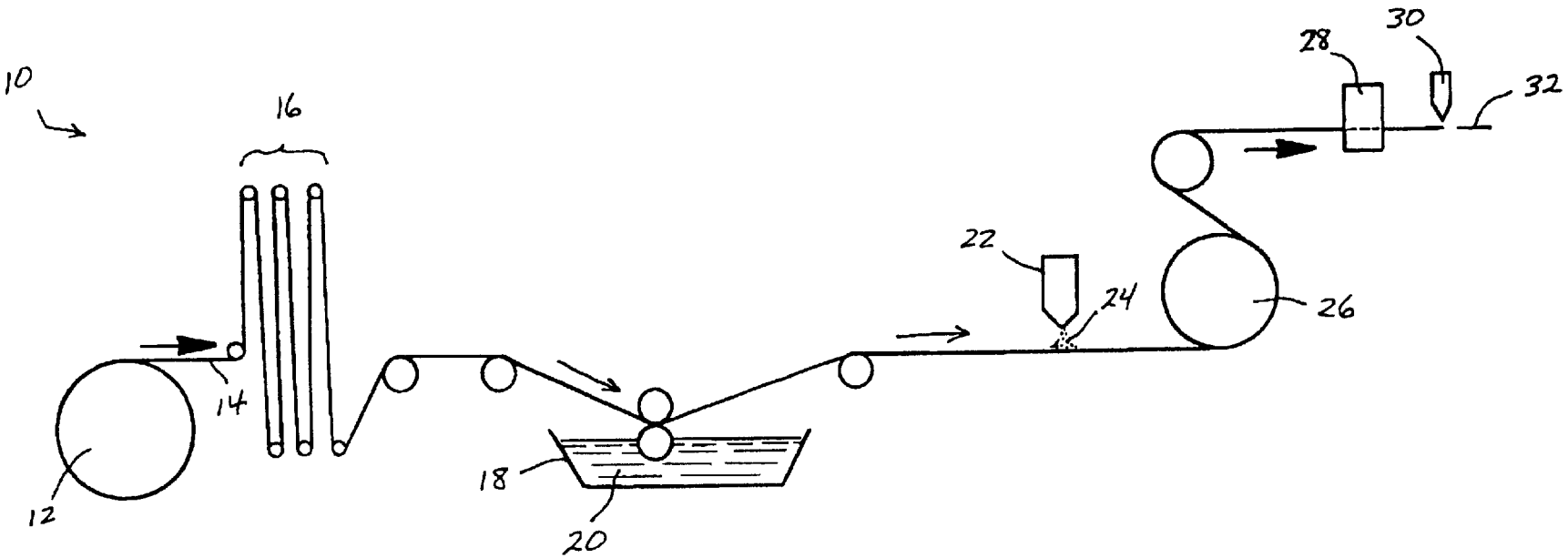
FIG. 1 is a schematic view in elevation of a conventional apparatus for manufacturing roofing shingles, including a coater for applying an asphalt coating material to a mat.

Referring now to the drawings, there is shown in FIG. 1 a conventional apparatus 10 for manufacturing roofing shingles. Initially, a mat or substrate is payed out from a roll 12 as a continuous sheet 14. The mat can be any type of material known for use in reinforcing roofing shingles, such as a web, scrim or felt of fibrous materials such as mineral fibers, cellulose fibers, rag fibers, mixtures of mineral and synthetic fibers, or the like. Preferably, the mat is a non-woven web of glass fibers.

The sheet is passed from the roll through an accumulator 16. The accumulator allows time for splicing one roll of mat to another, during which time the mat within the accumulator is fed to the manufacturing process so that the splicing does not interrupt manufacturing.

Next, the sheet is passed through a coater 18 where an asphalt coating material 20 is applied to the sheet. The coating material can be applied in any suitable manner. In the illustrated embodiment, the sheet is submerged in a supply of hot, molten coating material to completely cover the sheet with the tacky coating material. However, in other embodiments, the coating material can be sprayed on, rolled on, or applied to the sheet by other means.

The term "asphalt coating material" means any type of bituminous material suitable for coating asphalt roofing products, such as an asphalt, a tar, a pitch, or a mixture thereof. The asphalt can be either a manufactured asphalt produced by refining petroleum or a naturally occurring asphalt. The coating material can also include various additives and/or modifiers, such as inorganic fillers or mineral stabilizers, organic materials such as polymers, recycled streams, or ground tire rubber. In a particular embodiment of the invention, the coating material includes a filler of finely ground inorganic particulate matter, such as limestone dust, in an amount within a range of from about 40% to about 80% by weight of the coating material, typically from about 50% to about 70%.

The hot coated sheet is passed beneath one or more granule applicators 22 that discharge protective surface granules 24 onto the top of the sheet. In the manufacture of colored shingles, two types of granules are typically employed. Headlap granules are granules of relatively low cost used for the portion of the shingle that will be covered on the roof. Colored granules or prime granules are of relatively higher cost and are applied to the portion of the shingle that will be exposed on the roof. The granules may be applied such that some areas of the granules are different in color or shading from adjacent areas.

The sheet is passed around a drum 26 that presses the granules into the hot, tacky coating material and inverts the sheet sufficiently for any non-adhering granules to fall into a hopper (not shown) for recycling. Next, the sheet is passed through a cooling section 28 in which it is passed up and down between a number of rolls and sprayed with water to cool the coating material. Finally, the sheet is fed through a cutter 30, which cuts the sheet into a plurality of shingles 32.

Figure 2:
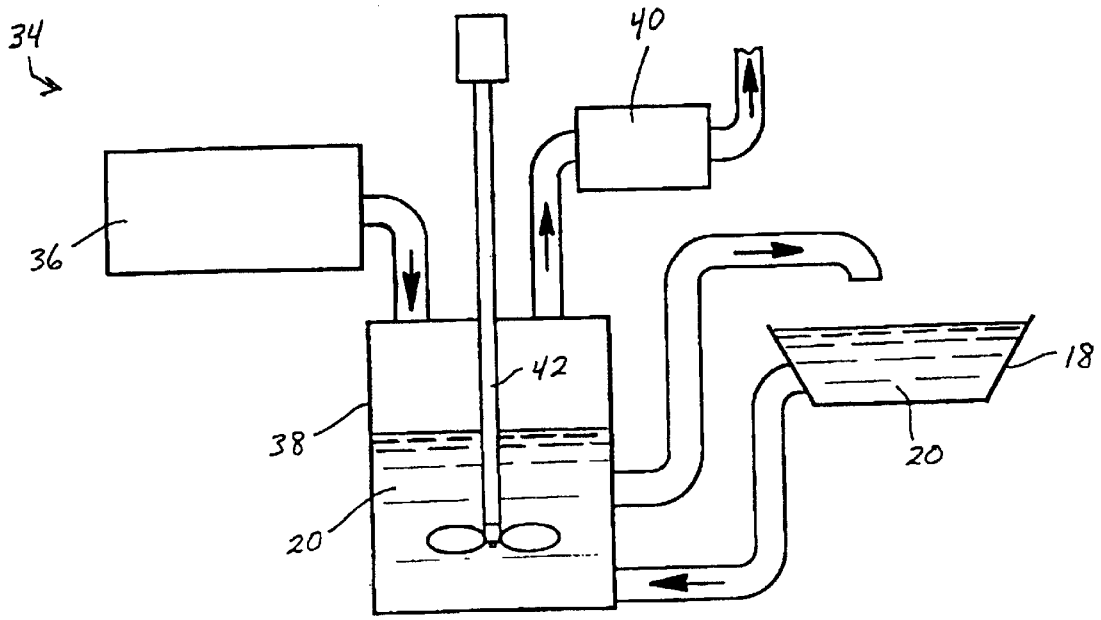
FIG. 2 is a schematic view in elevation of an apparatus for supplying the asphalt coating material to the coater of FIG. 1, including a vacuum pump for contacting the asphalt coating material with a vacuum according to the method of the invention.

Referring now to FIG. 2, there is shown an apparatus 34 for supplying the asphalt coating material 20 to the coater 18 of FIG. 1. The coating material is prepared in a mixer 36. In the method of the invention, the coating material is contacted with a vacuum prior to applying it to the mat, in order to reduce voids in the asphalt of the roofing product. While not intending to be limited by theory, it is believed that air voids are formed in the coating material in the mixing operation and/or when the coating material is pumped from the mixer to the coater. Air voids are easily formed because the coating material has a relatively high viscosity, particularly when it contains a filler. It is believed that the air voids in the asphalt ultimately reside in the finished roofing product. A possible mechanism is entrapment or migration of water into the air void which creates pressure in the void as the temperature increases, causing the void to expand. In the method of the invention, the coating material is contacted with a vacuum in an amount effective to reduce the voids in the coating material. Alternatively, the voids may comprise liquids, such as water or light ends, which are removed from the asphalt mixture by the application of vacuum as described herein.

It is important to contact the coating material with the vacuum prior to applying it to the mat. It is believed that contacting the coating material with a vacuum after applying it to the mat, or simultaneously with applying it to the mat, would not be as effective because the surface area of the asphalt exposed to the vacuum would not be as great, and therefore the voids pulled from the surface would not be as great.

In the illustrated embodiment, the coating material 20 is pumped from the mixer 36 to a storage tank such as a surge tank 38, where it is stored temporarily before pumping it to the coater 18. Excess coating material recirculates from the coater 18 to the surge tank 38. While the coating material is in the surge tank 38, it is contacted with a vacuum to reduce the voids in the coating material. The vacuum can be applied by any suitable vacuum device, such as the vacuum pump 40 shown in FIG. 2. The vacuum is applied in an amount effective to reduce the voids, typically in an amount of at least about 125 mm, and more typically at least about 380 mm of Hg. The amount of vacuum and the time of contact will vary depending on the particular apparatus, the composition of the coating material, and the volume of the coating material. Typically, the vacuum is applied for a time of at least about 5 minutes, and more typically at least about 10 minutes.

Preferably, the coating material is agitated with an agitator 42 during the vacuum contacting step. The agitator creates a turbulence so that different portions of the coating material flow to the surface of the coating material for exposure to the vacuum. The vacuum usually cannot penetrate very far past the surface of the coating material because of the high viscosity of the coating material. Any type of agitator suitable for stirring up the coating material can be used, such as a mechanical mixer as illustrated, or a series of baffles (not shown), or any other known means.

Figure 3:
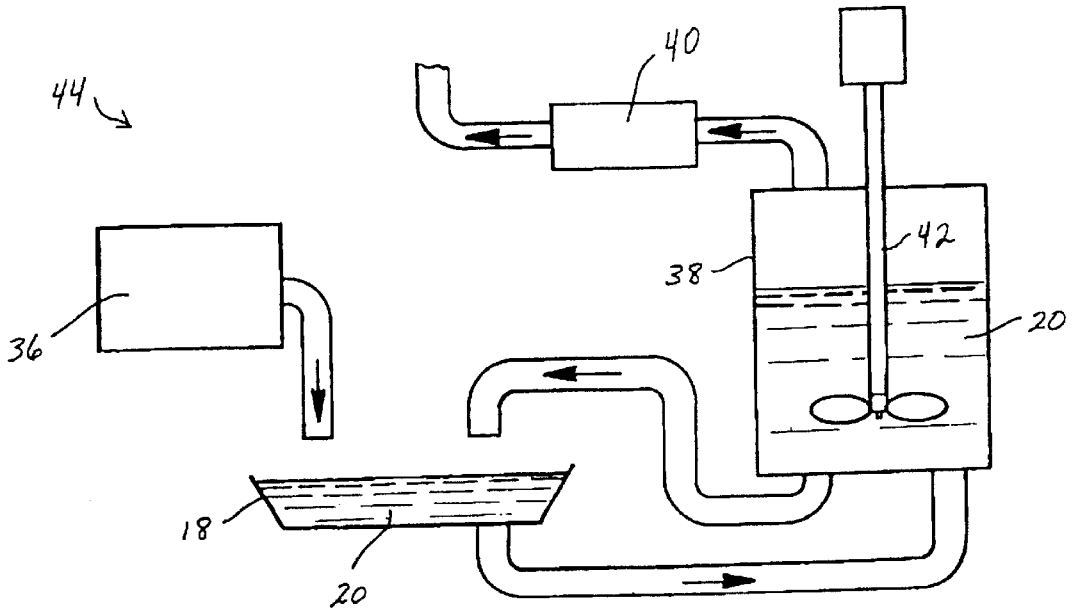
FIG. 3 is a schematic view in elevation of an alternate embodiment of the apparatus of FIG. 2.

FIG. 3 illustrates an alternate embodiment of an apparatus 44 for supplying the asphalt coating material 20 to the coater 18 of FIG. 1. The coating material is prepared in a mixer 36. Unlike the embodiment shown in FIG. 2, the coating material is pumped directly from the mixer into the coater 18. The coating material is then cycled between the coater and a surge tank 38. While in the surge tank, the coating material is contacted with a vacuum generated by a vacuum pump 40, and is agitated by an agitator 42. The cycling of the coating material between the coater and the surge tank is effective to reduce the air voids in the coating material before it is applied to the mat. In an alternative embodiment, additional vacuum sources (not shown) are applied to the asphalt while it resides in the surge tank and/or while the asphalt is being dispensed into the surge tank. In a further alternative embodiment (not shown), an additional vacuum source is provided at the point of application of the asphalt to the mat, or substantially immediately thereafter, to remove any remaining voids in the asphalt adjacent to the surface.

Figure 4:
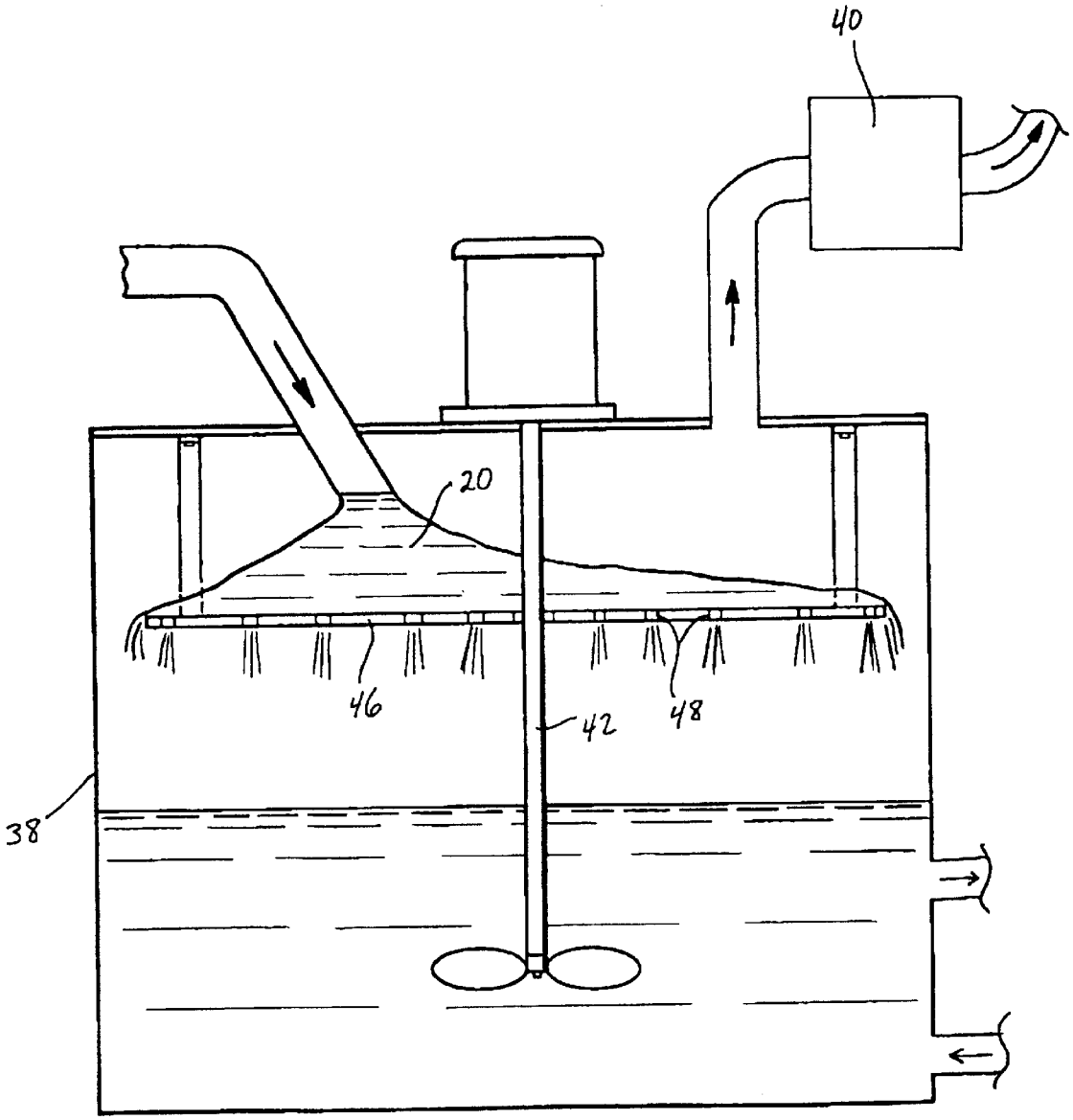
FIG. 4 is a schematic view in elevation of another alternate embodiment of an apparatus for contacting the asphalt coating material with a vacuum according to the method of the invention, including a baffle plate for increasing the surface area to volume ratio of the asphalt coating material.

Preferably, the coating material is manipulated during the vacuum contacting step to increase its ratio of surface area to volume. The increased surface area/volume ratio of the coating material increases the efficiency of the vacuum treatment. The surface area/volume ratio can be increased by any suitable means, such as by flowing the coating material as a curtain, or by pouring the coating material over a plate. In the embodiment shown in FIG. 4, the coating material 20 is poured over a baffle plate 46 to increase its surface area/volume ratio. The coating material flows through openings 48 in the baffle plate into the surge tank 38. A vacuum pump 40 applies a vacuum to the coating material while it is poured over the baffle plate. The coating material is agitated by an agitator 42 during the vacuum treatment.

Figure 5:
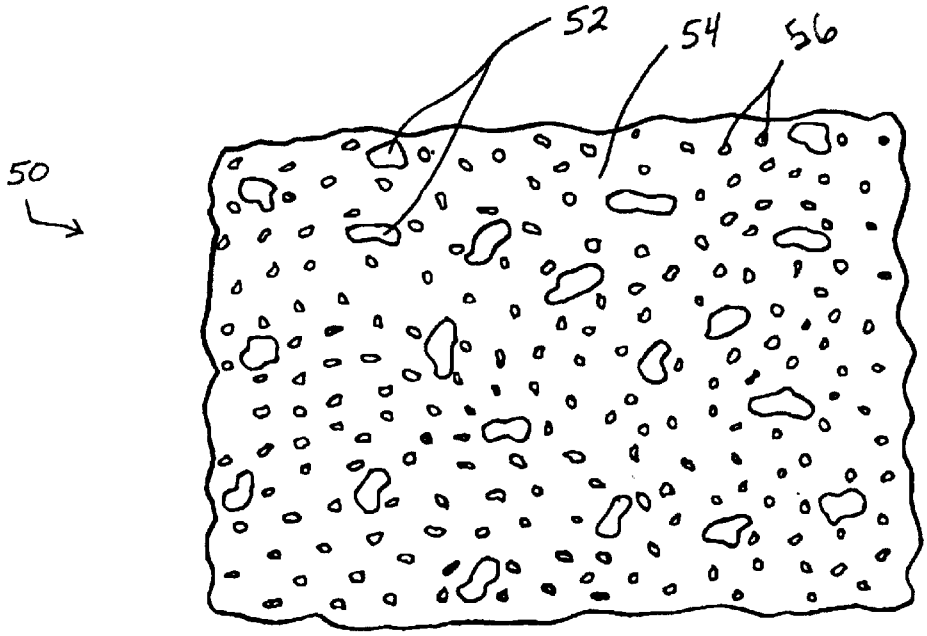
FIG. 5 is an enlarged cross-sectional view of an asphalt coating material not subjected to the method of the invention, showing air voids in the asphalt coating material.
Figure 6:
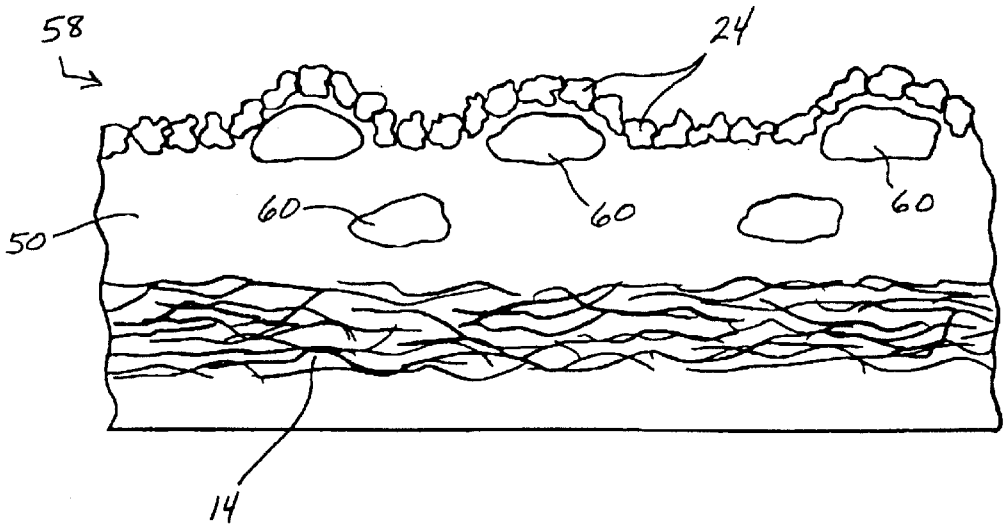
FIG. 6 is an enlarged cross-sectional view of a portion of a roofing shingle made with the asphalt coating material of FIG. 5, showing voids in the roofing shingle.
Figure 7:
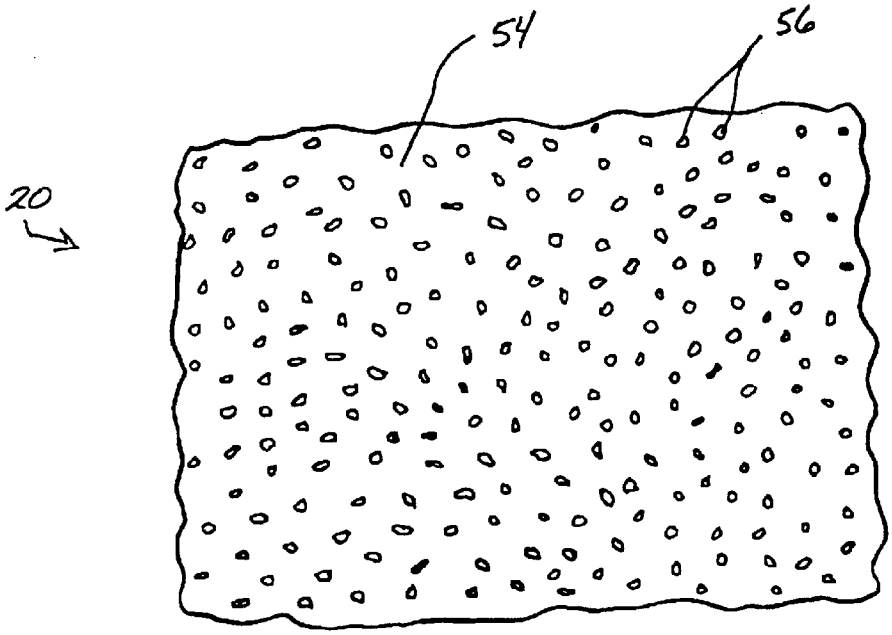
FIG. 7 is an enlarged cross-sectional view of an asphalt coating material contacted with vacuum according to the method of the invention, showing the air voids having been removed from the asphalt coating material.
Figure 8:
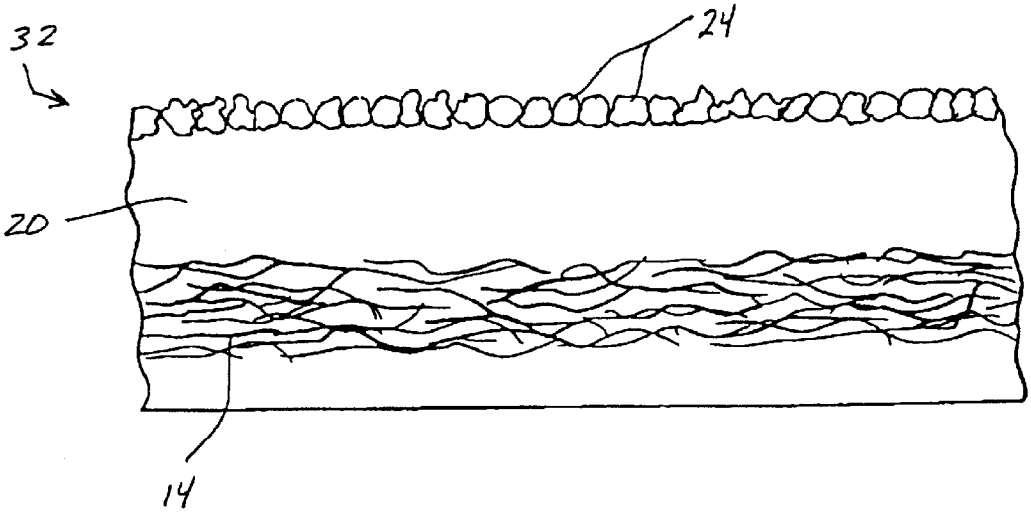
FIG. 8 is an enlarged cross-sectional view of a portion of a roofing shingle made with the asphalt coating material of FIG. 7, showing the roofing shingle substantially free from voids.

FIGS. 5–8 demonstrate the effectiveness of the method of the invention in reducing air voids in an asphalt coating material, and thereby reducing voids entrapped in the asphalt coating of a roofing shingle prepared with the coating material. As shown in FIG. 5, an asphalt coating material 50 not subjected to the method of the invention contains numerous dispersed air voids 52 in addition to asphalt 54 and filler particles 56. As shown in FIG. 6, a roofing shingle 58 includes a mat 14 coated with the coating material 50 of FIG. 5, and a surface layer of roofing granules 24. After a period of time on the roof, the shingle develops a number of voids 60 within the asphalt adjacent the surface layer of roofing granules 24. The voids 60 adjacent the surface layer of roofing granules 24 may be evident as a raised spot, or bump, on the surface of the product Over time, the surface of the roofing product may rupture at the void, and expose a portion of the interior of the roofing product. The exposed portion ma result in degradation of the roofing product from the elements In contrast, FIG. 7 shows an asphalt coating material 20 which has been contacted with vacuum according to the method of the invention. The air voids 52 of the coating material 50 shown in FIG. 5 have been removed from the coating material 20 in FIG. 7. As shown in FIG. 8, a roofing shingle 32 prepared with the coating material 20 of FIG. 7 does not have voids in the asphalt adjacent the granules, or at least a substantially reduced number of voids.

As used herein, the voids described relate to the voids in the asphalt, not "surface voids", a term which is used to occasionally refer to instances where granule voids exist (i.e. where small pockets of granules do not adhere to the web, leaving an exposed asphalt surface) or coating voids exist (where small sections of coating do not adhere to the mat, leaving an exposed mat surface). Instead, as described above, the "voids" herein relate to pockets within the asphalt, typically air or some other gas, or liquid, and include such voids that rupture as described above.

Preferably, the method of the invention reduces the void content of the coating material by at least about 25%, and more preferably at least about 50%.

Preferably, the coating material treated by the method of the invention has a void content of not greater than about 6%, and more preferably not greater than about 3%. The void content is calculated using a method based on ASTM D 2734, method B, as follows (in decimal form):

1.0−Measured Filled coating density[(Asphalt Weight %/Asphalt Density)+(Filler Weight %/Filler Density)]

Preferably, the method of the invention reduces voids visible at the surface of the roofing product by at least about 25% compared to the same roofing product made with a coating material not subjected to the method, and more preferably at least about 50%. The reduction in visible voids is measured by counting the number of voids visible on the top surface of a 4½ inch by 4½ inch samples of roofing products prepared with and without the method of the invention. A preferred method to measure the visible voids includes soaking the samples for about twelve hours in tap water at about room temperature. The samples are then heated under vacuum at approximately 25 inches of water; the heat is applied to the samples at a rate for the samples to reach 190 degrees F in about 5½ hours. Once the samples are heated, the heat source is removed, but the vacuum source is maintained until the samples cool to approximately room temperature, or about 80–85 deg. F. In one example, the cooling step lasted approximately 12 hours. The samples were then removed and the voids visible at the surface were counted.

The principle and mode of operation of this invention have been described in its preferred embodiments. However, it should be noted that this invention may be practiced otherwise than as specifically illustrated and described without departing from its scope. For example, while the invention has been illustrated in relation to a particular type of roofing shingle, it is to be understood that the invention is also applicable to other types of shingles and other roofing products. While the reduction in voids in the coating material has been described in terms of air voids, it is to be understood that the voids can be produced by other gases such as inert gases, or non-asphalt liquids, such as water. Further, while the vacuum contacting of the coating material has been shown in relation to a surge tank, it is to be understood that the vacuum contacting can occur at any location in the process prior to applying the coating material to the mat.

What is claimed is:

1. A method of producing an asphalt roofing product having reduced voids visible on a top surface, comprising the steps of:

contacting an asphalt coating material having voids with a vacuum in an amount effective to reduce the voids in the coating material; and coating a mat with the coating material to make an asphalt roofing product;

wherein the voids are introduced into the coating material prior to the coating step, and the vacuum contacting step occurring prior to the coating step, and the vacuum contacting step causing a reduction of at least about 25% in the number of voids visible on the top surface of the roofing product compared to the same roofing product made with a coating material not contacted with vacuum.

2. The method defined in claim 1 wherein the coating material is agitated with an agitator during the vacuum contacting step to expose different portions of the coating material to the vacuum.

3. The method defined in claim 1 wherein the coating material is manipulated during the vacuum contacting step to increase a ratio of surface area to volume of the coating material.

4. The method defined in claim 1 wherein the coating material is contacted with a vacuum of at least about 125 mm of Hg.

5. The method defined in claim 1 wherein the vacuum contacting step causes the coating material to have a void content of not greater than about 6%.

6. The method defined in claim 5 wherein the vacuum contacting step causes the coating material to have a void content of not greater than about 3%.

7. The method defined in claim 1 wherein the vacuum contacting step is effective to reduce the void content of the coating material by at least about 25%.

8. The method defined in claim 7 wherein the vacuum contacting step is effective to reduce the void content of the coating material by at least about 50%.

9. The method defined in claim 1 wherein the voids visible on the top surface of the roofing product are reduced by at least about 50%.

10. The method defined in claim 3 wherein the manipulation is performed by flowing the coating material as a curtain, pouring the coating material over a plate, or transferring the coating material to and/or from a holding tank.

11. A method of producing an asphalt roofing product having reduced voids visible on a top surface, comprising the steps of:

contacting a filled asphalt coating material having voids with a vacuum in an amount effective to reduce the voids in the coating material, the coating material containing a filler in an amount within a range of from about 40% to about 80% by weight of the coating material; and coating a mat with the coating material to make an asphalt roofing product;

wherein the voids are introduced into the coating material prior to the coating step, and the vacuum contacting step occurring prior to the coating step, and the vacuum contacting step causing a reduction of at least about 25% in the number of voids visible on the top surface of the roofing product compared to the same roofing product made with a coating material not contacted with vacuum.

12. The method defined in claim 11 wherein the coating material is agitated with an agitator during the vacuum contacting step to expose different portions of the coating material to the vacuum.

13. The method defined in claim 11 wherein the coating material is manipulated during the vacuum contacting step to increase a ratio of surface area to volume of the coating material.

14. The method defined in claim 11 wherein the coating material is contacted with a vacuum of at least about 125 mm of Hg.

15. The method defined in claim 11 wherein the vacuum contacting step causes the coating material to have a void content of not greater than about 6%.

16. The method defined in claim 11 wherein the vacuum contacting step is effective to reduce the void content of the coating material by at least about 25%.

17. The method defined in claim 13 wherein the manipulation is performed by flowing the coating material as a curtain, pouring the coating material over a plate, or transferring the coating material to and/or from a holding tank.

18. A method of producing asphalt roofing shingles having reduced voids visible on a top surface, comprising the steps of:

contacting a filled asphalt coating material having voids with a vacuum in an amount effective to reduce the voids in the coating material, the coating material containing a filler in an amount within a range of from about 40% to about 80% by weight of the coating material;

coating a mat with the coating material to make an asphalt-coated sheet;

applying granules to the asphalt-coated sheet; and cutting the asphalt-coated sheet into a plurality of roofing shingles;

wherein the voids are introduced into the coating material prior to the coating step, and the vacuum contacting step occurring prior to the coating step, and the vacuum contacting step causing a reduction of at least about 25% in the number of coating material voids visible on the top surface of the roofing shingles compared to the same roofing shingles made with a coating material not contacted with vacuum.

19. The method defined in claim 18 wherein the vacuum contacting step causes the coating material to have a coating material void content of not greater than about 6%.

* * * * *